US010557636B2

(12) United States Patent
Oh et al.

(10) Patent No.: US 10,557,636 B2
(45) Date of Patent: Feb. 11, 2020

(54) OVEN

(71) Applicant: SAMSUNG ELECTRONICS CO., LTD., Suwon-si, Gyeonggi-do (KR)

(72) Inventors: Dong Jin Oh, Yongin-si (KR); Cheol Eun Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 390 days.

(21) Appl. No.: 15/314,306

(22) PCT Filed: Mar. 27, 2015

(86) PCT No.: PCT/KR2015/003048
§ 371 (c)(1),
(2) Date: Nov. 28, 2016

(87) PCT Pub. No.: WO2015/182864
PCT Pub. Date: Dec. 3, 2015

(65) Prior Publication Data

US 2017/0198922 A1 Jul. 13, 2017

(30) Foreign Application Priority Data

May 28, 2014 (KR) ..... 10-2014-0064226

(51) Int. Cl.
*F24C 15/16* (2006.01)

(52) U.S. Cl.
CPC ..... *F24C 15/168* (2013.01)

(58) Field of Classification Search
CPC ..... F24C 15/16; F24C 15/168; F24C 15/162; A47J 37/0694
(Continued)

(56) References Cited

U.S. PATENT DOCUMENTS 3,706,302 A * 12/1972 Helgeson ..... F24C 15/007 126/19 R
2004/0112371 A1* 6/2004 Le ..... F24C 15/16 126/334
(Continued)

FOREIGN PATENT DOCUMENTS

DE 10102589 8/2002
EP 1748257 1/2007
(Continued)

OTHER PUBLICATIONS

European Communication dated Sep. 21, 2018 in European Patent Application No. 15800427.5.
(Continued)

*Primary Examiner* — Vivek K Shirsat
(74) *Attorney, Agent, or Firm* — Staas & Halsey LLP

(57) ABSTRACT

Disclosed herein is an oven having guide rails. The oven includes a coking compartment, a shelf member disposed at an inside the cooking compartment and provided such that food substance is mounted, a plurality of guide rails installed such that the shelf member is withdrawn from the cooking compartment, and a fixing wire installed as to connect the plurality of guide rails and having a plurality of contact units configured to make contact with the plurality of guide rails, respectively, and the at least one contact unit is formed while provided with a step. The left and right movements of guide rails may be able to be stabilized by use of the fixing wire stably coupled to the guide rails.

15 Claims, 12 Drawing Sheets

(58) Field of Classification Search
USPC ..... 126/339, 337 R, 340, 337 A
See application file for complete search history.

(56) References Cited

U.S. PATENT DOCUMENTS

| | | | | |
|---|---|---|---|---|
| 2005/0217501 | A1 | 10/2005 | Babucke et al. | |
| 2007/0261694 | A1 | 11/2007 | Le et al. | |
| 2011/0309732 | A1 | 12/2011 | Horil et al. | |
| 2013/0118471 | A1* | 5/2013 | Sprigler | F24C 15/168 126/19 R |
| 2014/0137856 | A1 | 5/2014 | Elkasevic | |

FOREIGN PATENT DOCUMENTS

| | | |
|---|---|---|
| EP | 2042811 | 4/2009 |
| ES | 2392291 | 12/2012 |
| JP | 2011-112301 | 6/2011 |

OTHER PUBLICATIONS

International Search Report dated Jun. 22, 2015 in International Patent Application No. PCT/KR2015/003048.
Extended European Search Report dated Apr. 26, 2018 in European Patent Application No. 15800427.5.
European Communication dated Apr. 17, 2019 in European Patent Application No. 15800427.5.

* cited by examiner

[Fig. 1]
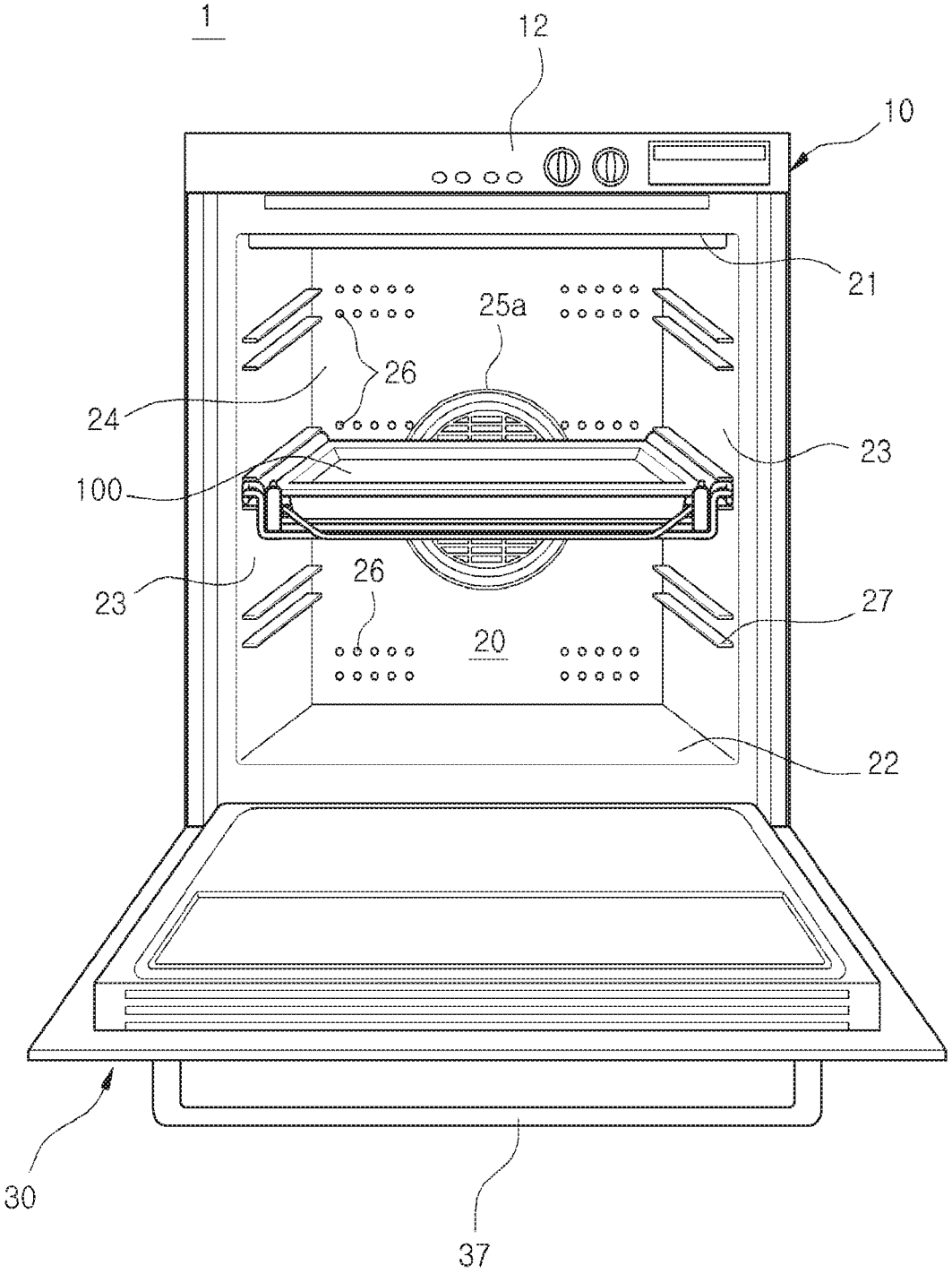

[Fig. 2]
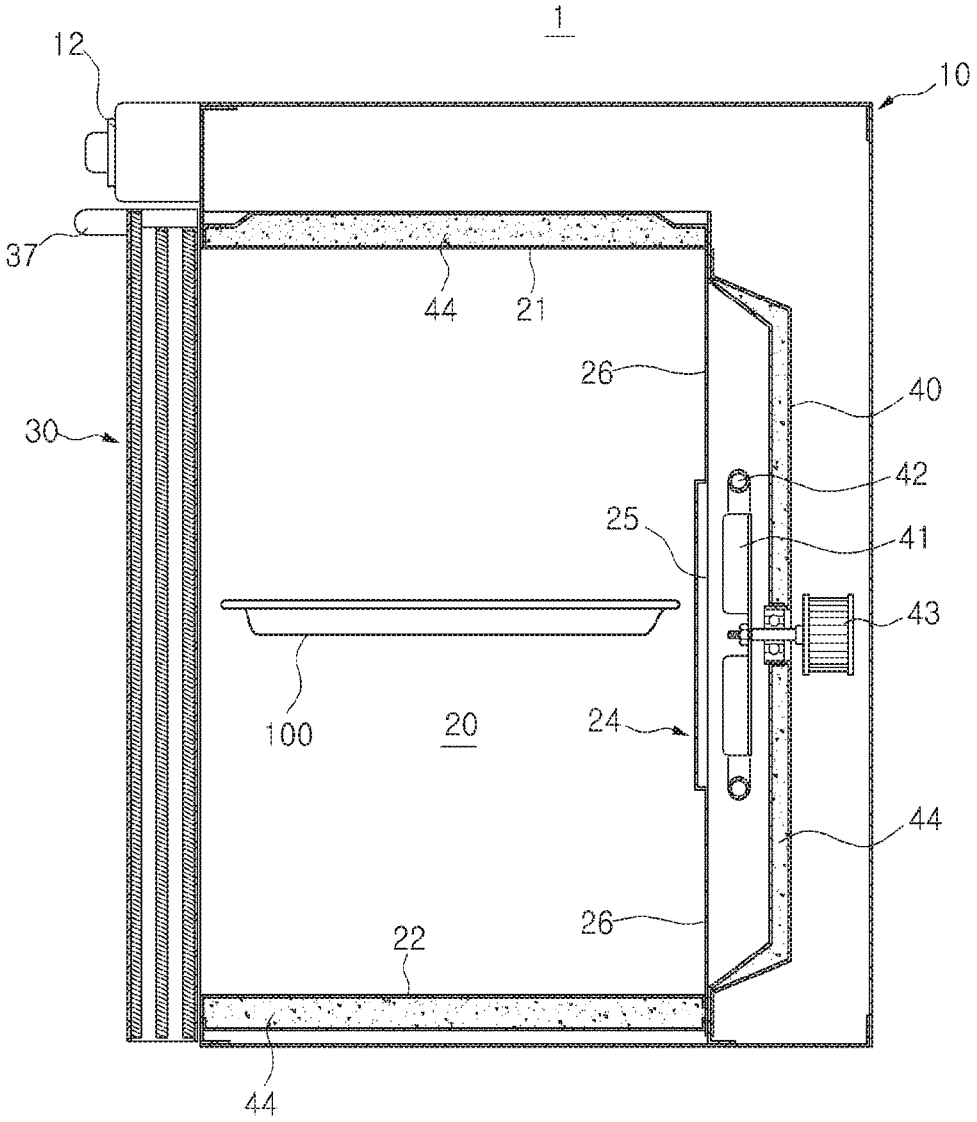

[Fig. 3]
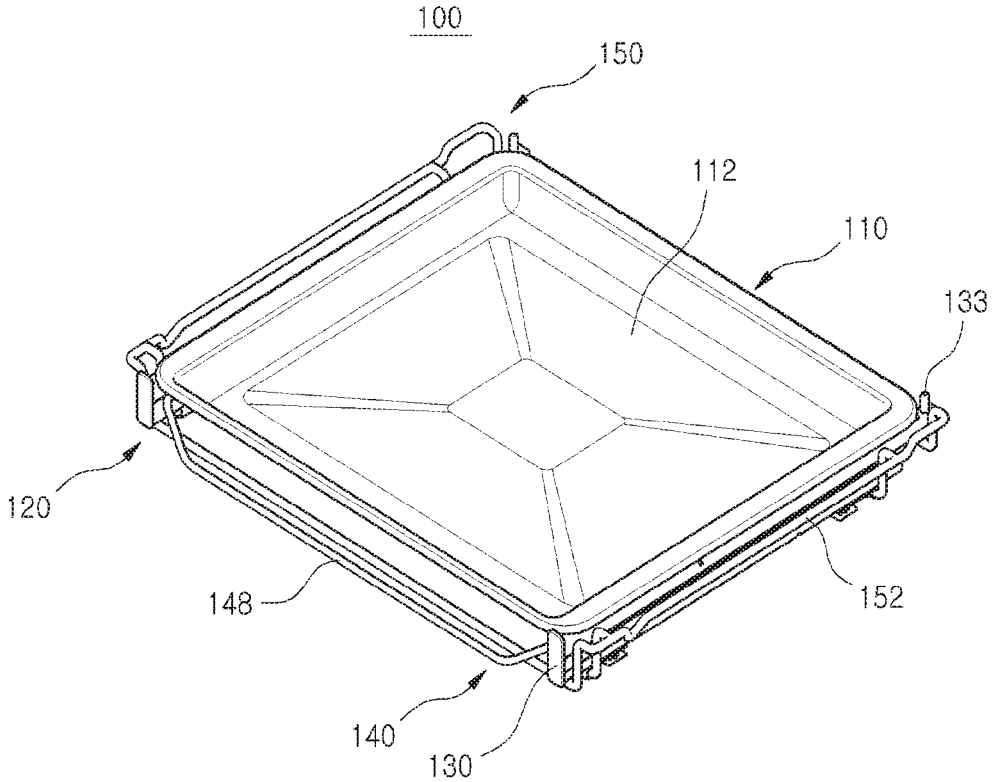
[Fig. 4]
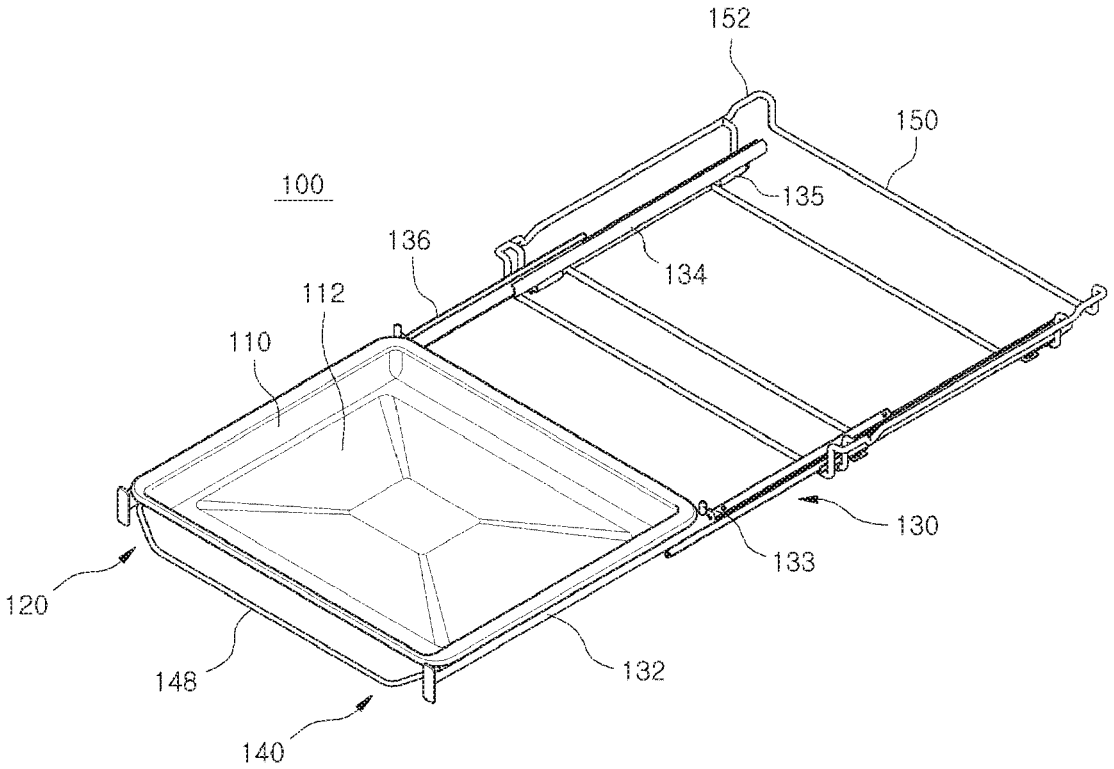

[Fig. 5]
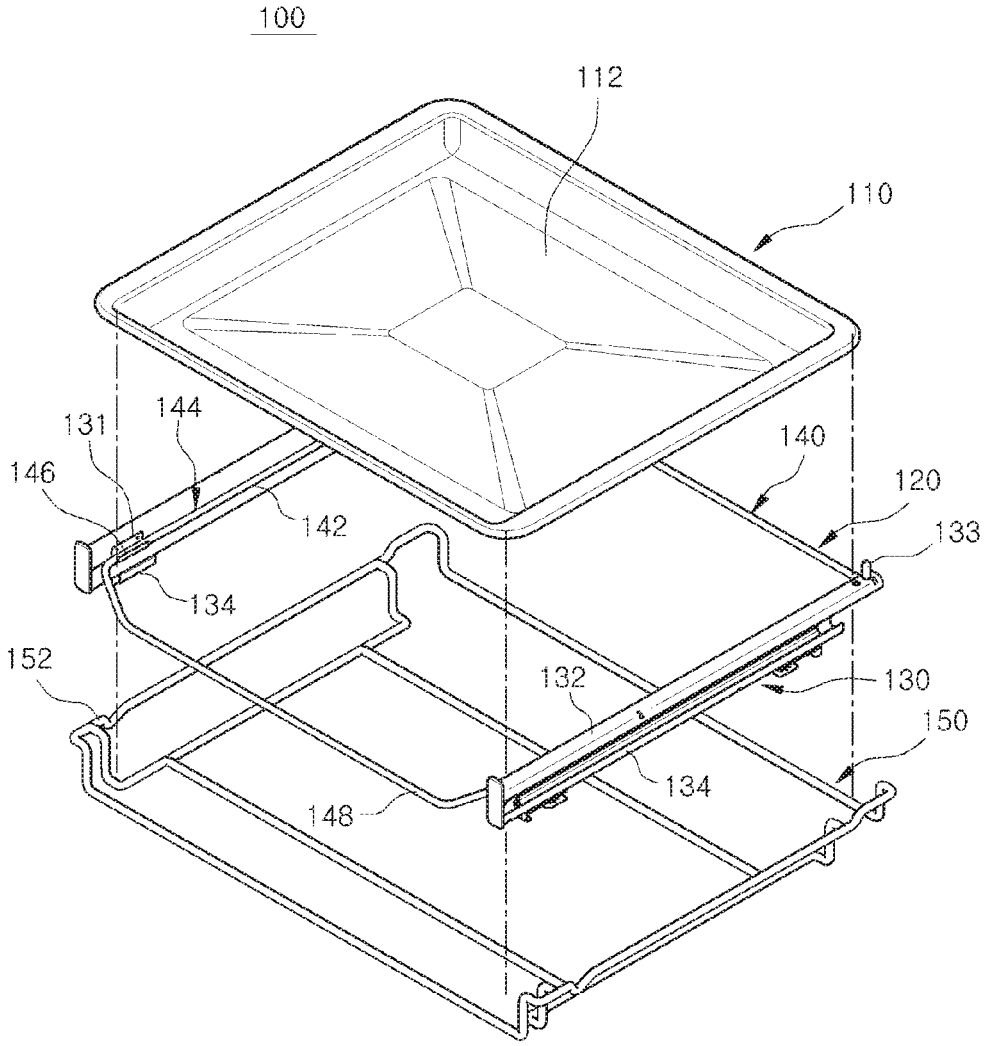

[Fig. 6]
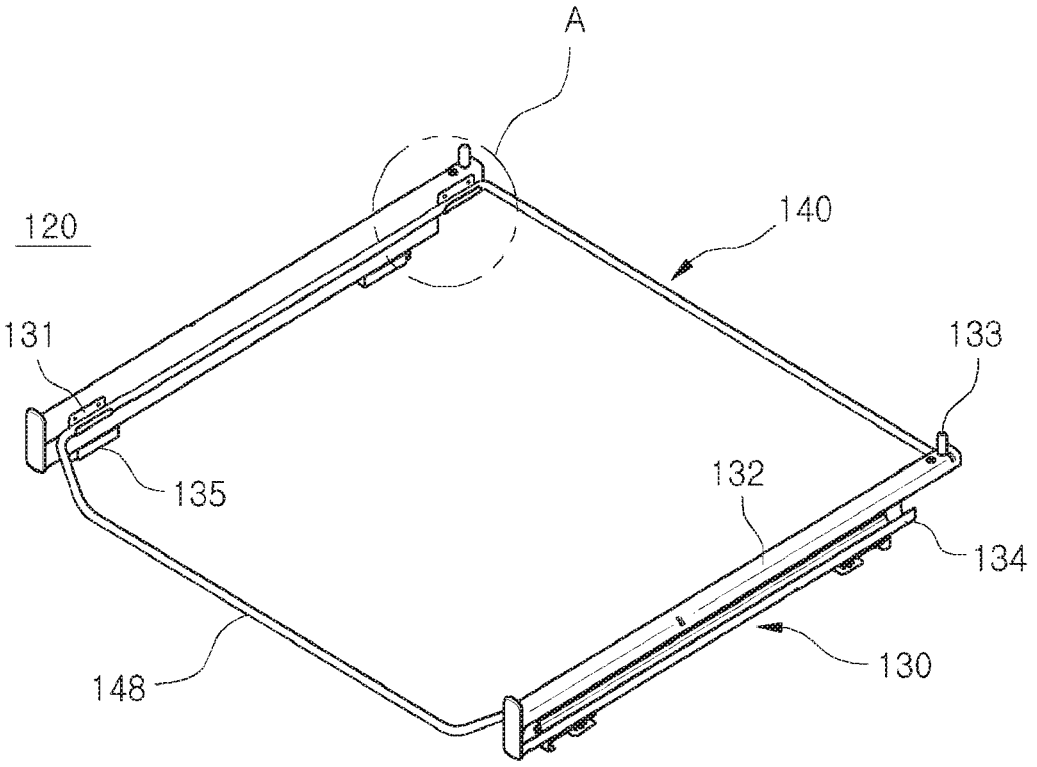

[Fig. 7]
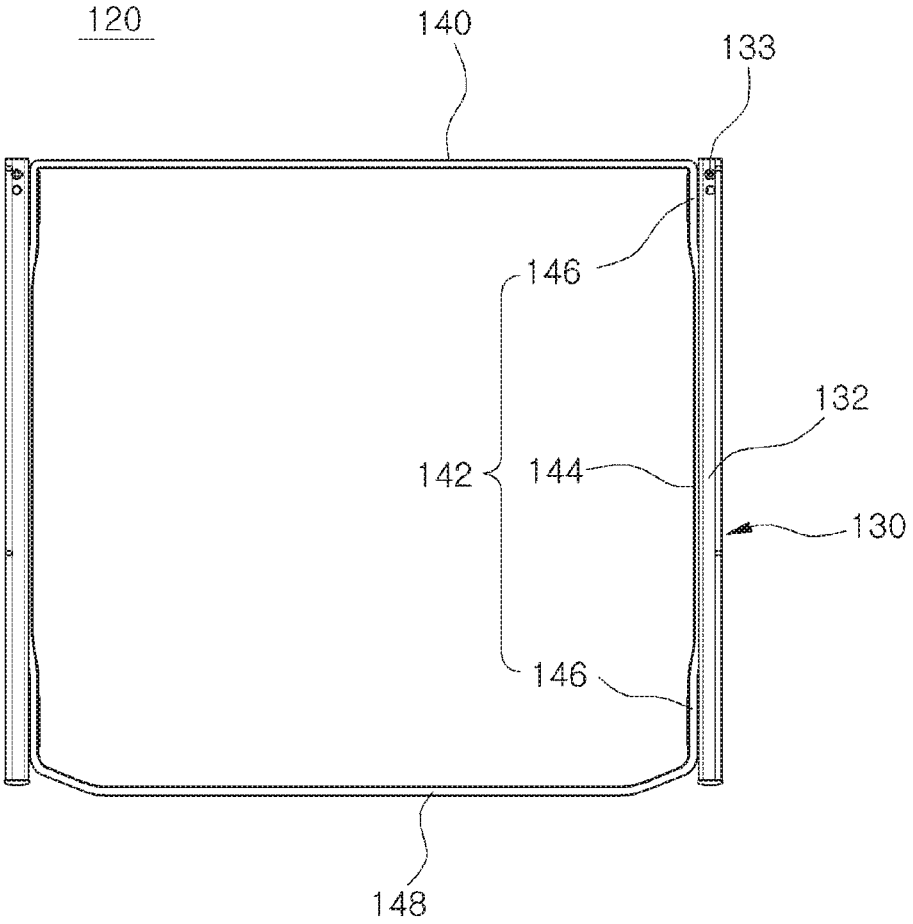

[Fig. 8]
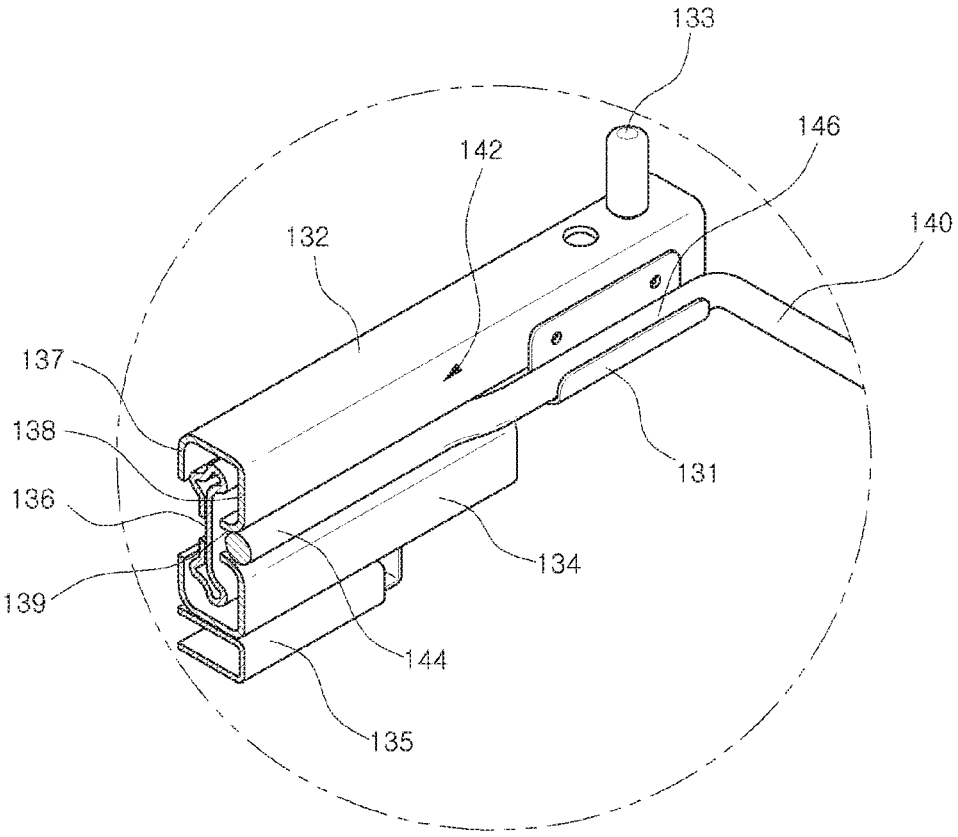

[Fig. 9]
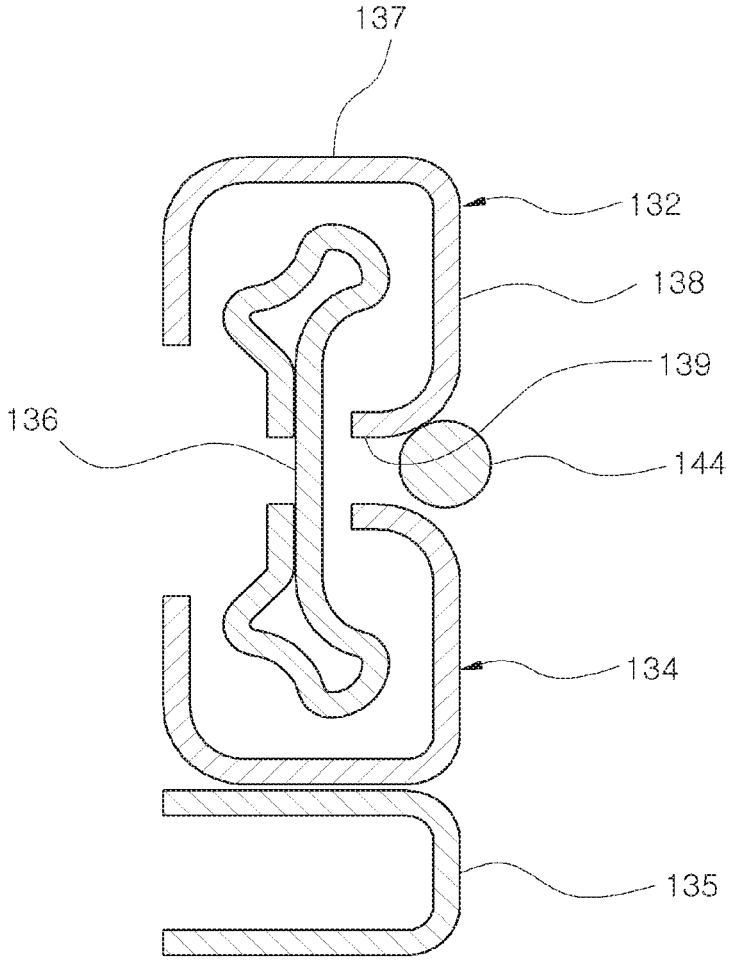

[Fig. 10]
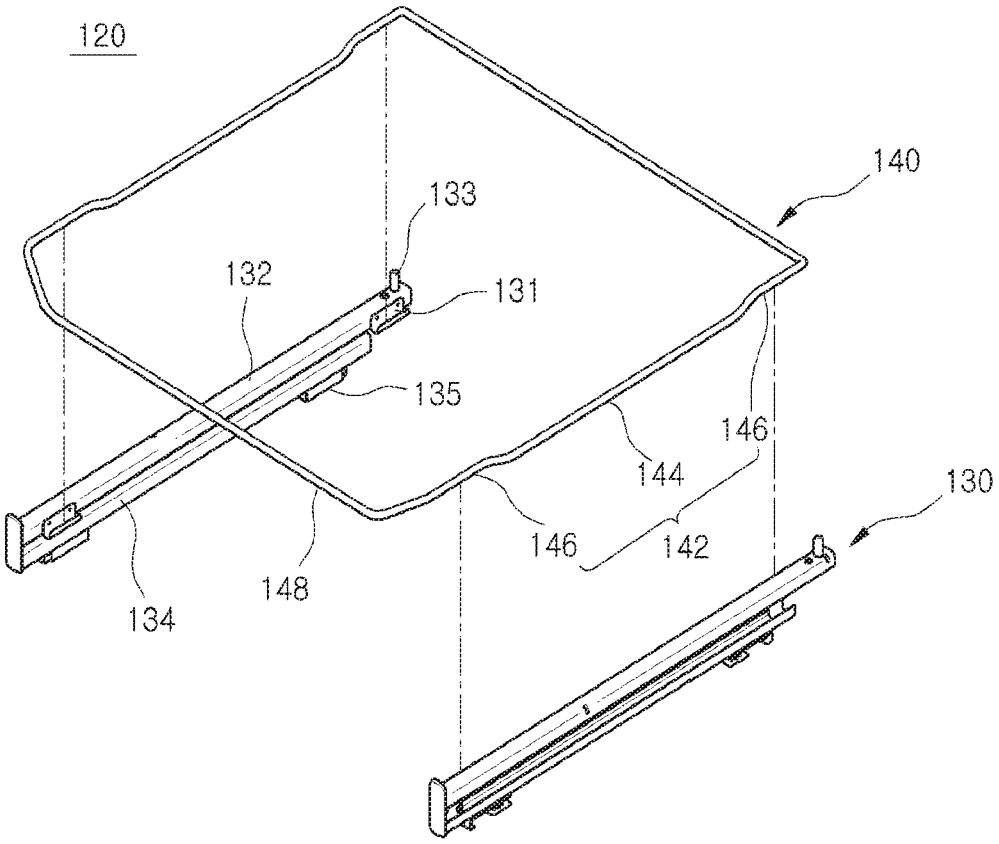

[Fig. 11]
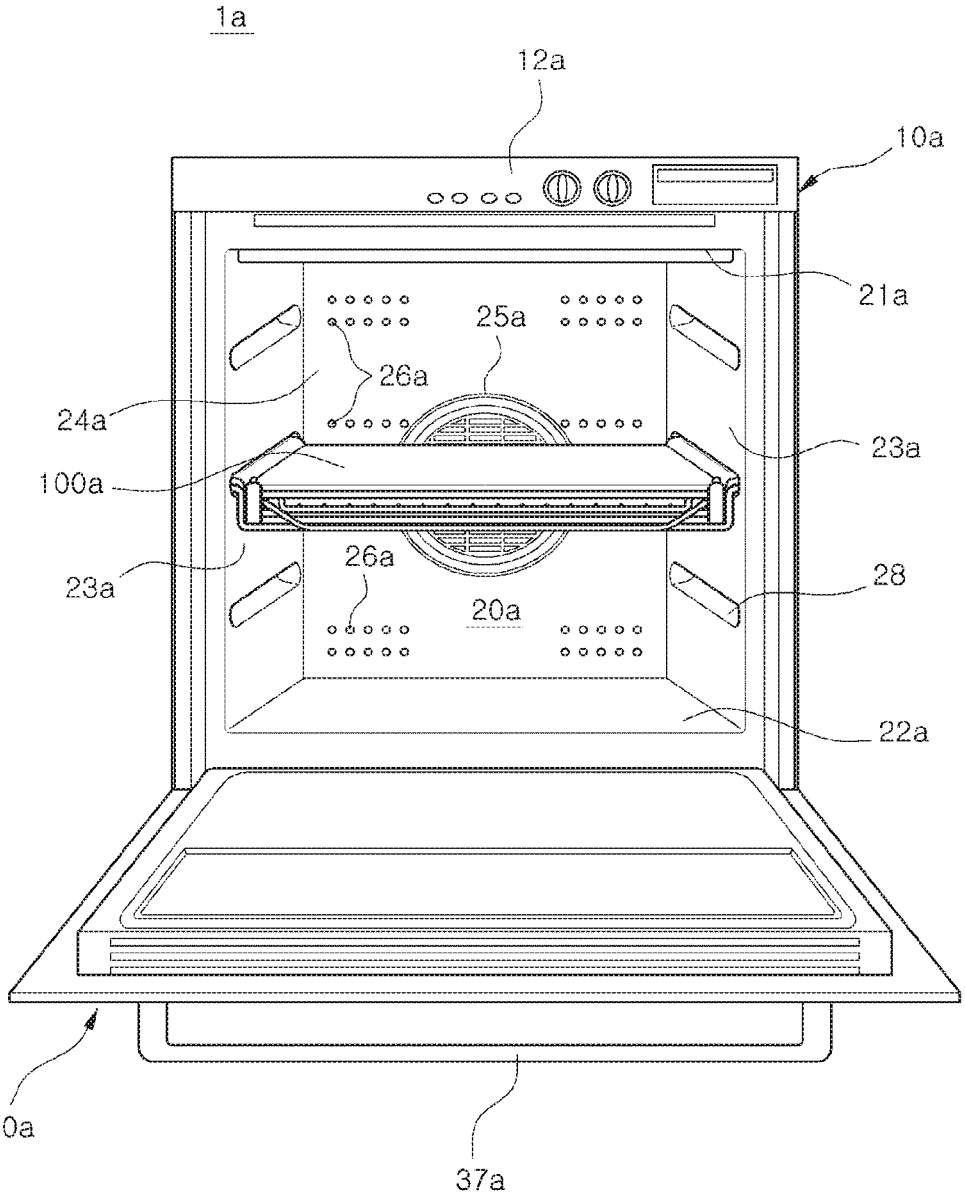

[Fig. 12]
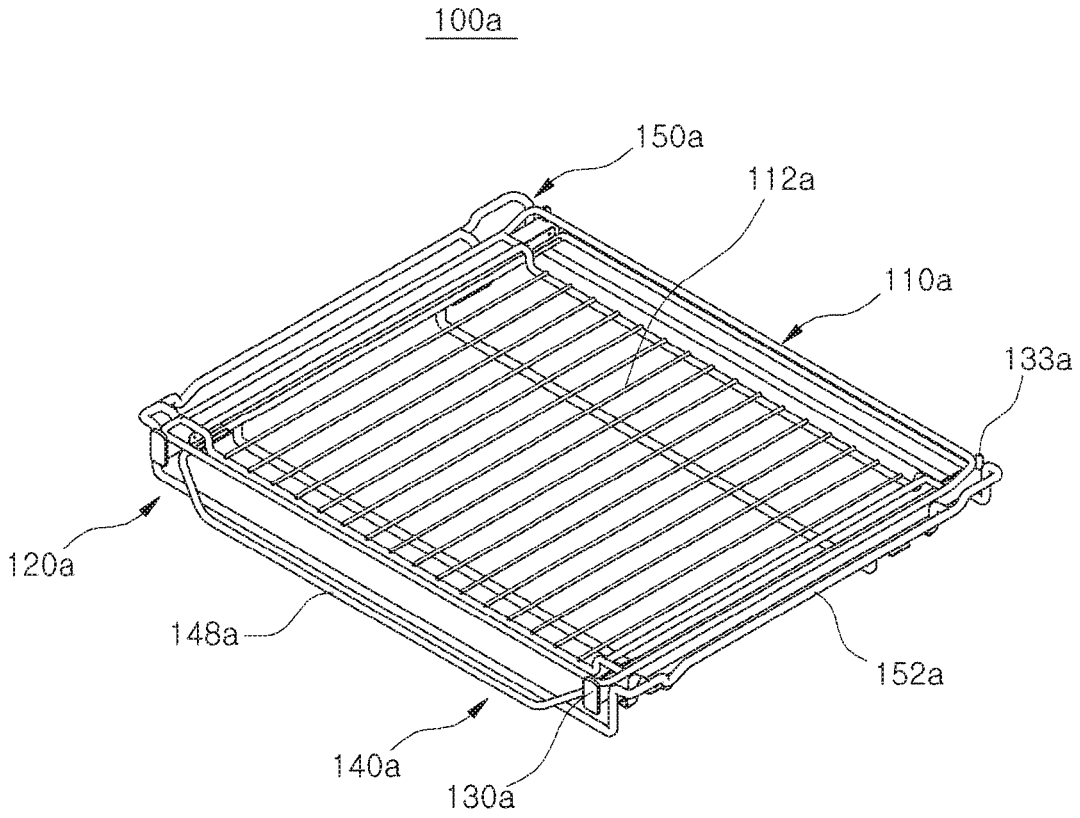

[Fig. 13]
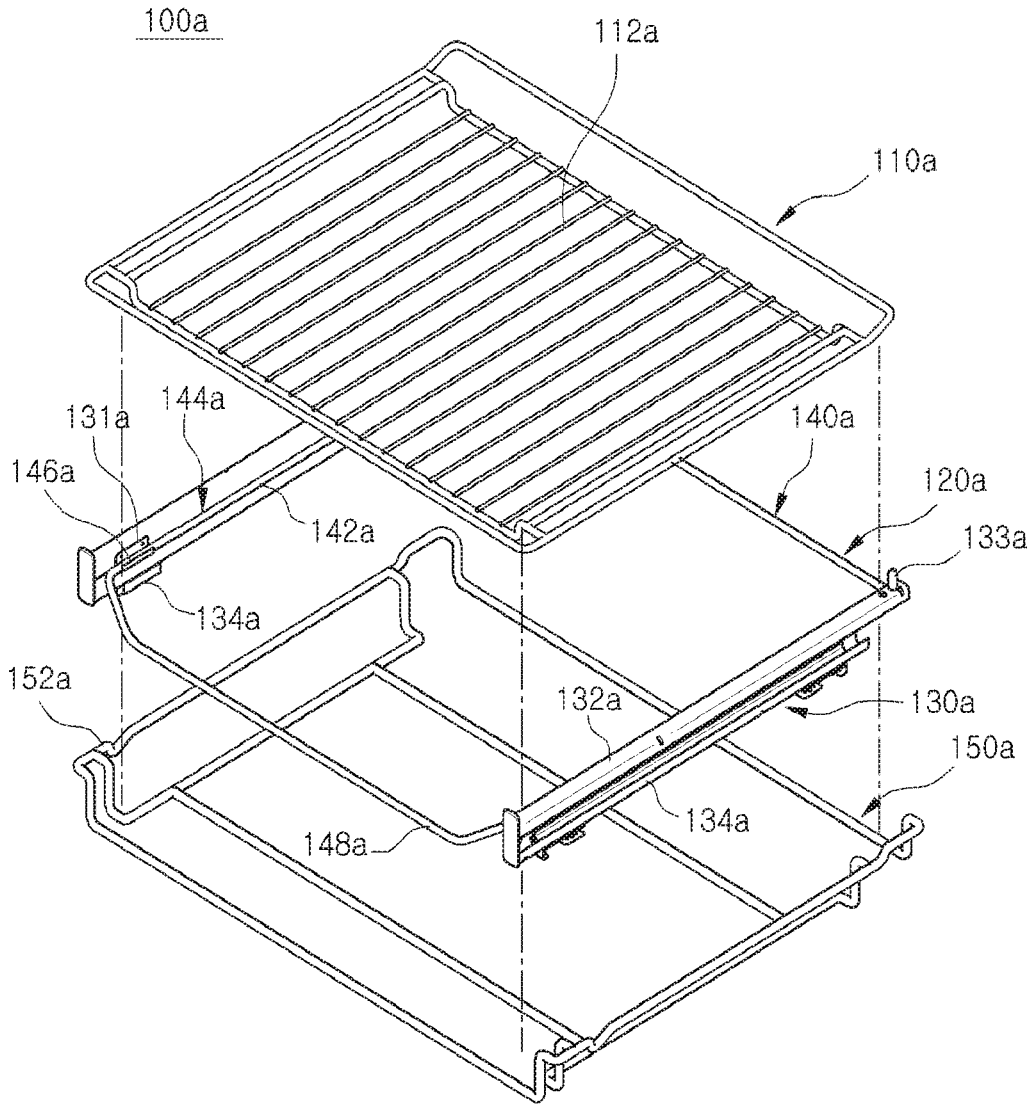

OVEN

CROSS-REFERENCE TO RELATED APPLICATIONS

This application is a U.S. National stage application under 35 USC 371 of PCT international application PCT/KR2015/003048, filed on Mar. 27, 2015 and claims the benefit of Korean Patent Application No. 10-2014-0064226, filed on May 28, 2014, the contents are incorporated herein by reference.

TECHNICAL FIELD

Embodiments of the present disclosure relate to an oven, and more particularly, an oven having guide rails.

BACKGROUND ART

An oven is an apparatus configured to seal, heat, and cook food substance, and in general may be divided into an electric-type oven, a gas-type oven, and an electronic-type oven according to a heat source thereof. The electric-type oven is configured to use an electric heater as a heat source, as the gas-type oven and the electronic-type oven are configured to use a heat by gas and by a frictional heat of water molecules by high frequency, respectively.

A cooking compartment configured to heat food substance may be provided at an inside the oven. At least one shelf member configured to settle food substance may be disposed at the cooking compartment. The shelf member may be installed as to be withdrawn in a sliding manner toward a front surface for convenience of a user. At this time, the shelf member may be withdrawn by use of a guide member.

In general, the guide member may include a pair of rails movably installed at side surfaces of the cooking compartment. The each of the pair of rails is installed at the each side surface of the coking compartment, thereby may be separately moved. Thus, in a case when a user withdraws and settles the shelf member from the rails, the each rail may be separately disposed, and an inconvenience may be present.

There is an oven using a fixing wire as to connect one pair of rails. However, the fixing wire is press-fitted to a bracket provided at the rail, cleaning the fixing wire by separating may be difficult. In addition, only the portion of the fixing wire coupled by the bracket is fixed, and thus the fixing wire may not be able to stably connect the rail.

DISCLOSURE OF INVENTION

Technical Problem

It is an aspect of the present disclosure to provide an oven having guide rails configured to stably move when withdrawing a shelf member.

It is another aspect of the present disclosure to provide an oven provided with guide rails and a fixing wire firmly inserted to each other and fixedly coupled to each other by a step structure of the fixing wire.

Additional aspects of the disclosure will be set forth in part in the description which follows and, in part, will be obvious from the description, or may be learned by practice of the disclosure.

Solution to Problem

In accordance with one aspect of the present disclosure, an oven includes a cooking compartment, a shelf member, and a fixing wire. The shelf member may be disposed at an inside the cooking compartment and allowing food substance to be mounted thereon. The plurality of guide rails may be installed such that the shelf member is withdrawn from the cooking compartment. The fixing wire may be installed as to connect the plurality of guide rails and having a plurality of contact units configured to make contact with the plurality of guide rails, respectively. The at least one contact unit may be formed while provided with a step.

Each of the guide rails includes a plurality of first brackets at which the fixing wire is mounted.

The at least one contact unit may include a plurality of mounting units mounted at the plurality of first brackets and an insertion unit provided in between the plurality of mounting units, and the plurality of mounting units and the insertion unit may be formed while provided with a step.

The plurality of mounting units each may be mounted at each of the plurality of first brackets in a downward direction, and the insertion unit may be disposed such that at least one portion of each of the guide rails is positioned at an upper portion of the insertion unit.

The plurality of first brackets each may be disposed at one side surface of each of the guide rails.

The fixing wire may be provided in the shape of a closed loop as to connect the plurality of guide rails.

The fixing wire may be positioned in between the plurality of guide rails.

The fixing wire may include a handle unit provided as to be grabbed.

The oven may further include an installation member at which the plurality of guide rails is mounted.

The plurality of guide rails may each include a first rail connected by the fixing and a second rail mounted at the installation member.

The first rail may include a first bracket at which the fixing wire is mounted, and the second rail may include a second bracket coupled to the installation member.

The first rail may include at least one safety member configured to fix the shelf member to one direction.

The installation member may be mounted at an inner side wall of the cooking compartment, as to support the shelf member and the guide rails.

The cooking compartment may include at least one supporting member being installed at an inner side wall of the cooking compartment, such that the installation member is mounted at the inner side wall of the cooking compartment.

An inner side wall of the cooking compartment may include at least one concave surface such that the installation member is mounted at the inner side wall of the cooking compartment.

In accordance with another aspect of the present disclosure, an oven includes a shelf member, an installation member and a guide member. The shelf member may allow food substance to be placed. The installation member may be detachably mounted at an inside the cooking compartment. The guide member may have a plurality of guide rails disposed in between the shelf member and the installation member. The guide member may also have a fixing wire connecting the plurality of guide rails.

The plurality of guide rails may each include a first rail at which the shelf member is mounted, and a second rail coupled to the installation member, and the fixing wire may be installed as to connect each first rail.

The first rail may include a plurality of first brackets at which the fixing wire is mounted.

The fixing wire may include a plurality of mounting units being mounted at the plurality of first brackets and an insertion unit provided in between the plurality of mounting units. The plurality of mounting units and the insertion unit may be formed while provided with a step.

The plurality of guide rails may each include a first rail being connected by the fixing wire, and the first rail may include an upper surface unit at which the shelf member is mounted.

The first rail may include a side surface unit provided with one side thereof connected to the upper surface unit while the other side thereof is connected to a lower surface unit, and a first bracket at which the fixing wire is mounted may be installed at the side surface unit.

At least one portion of the fixing wire may be positioned at a lower portion of the lower surface unit.

In accordance with another aspect of the present disclosure, an oven includes a shelf member, a pair of guide rails, and a fixing wire. The shelf member may be disposed at an inside a cooking compartment. The pair of guide rails may be installed as to move the shelf member, and each having a plurality of rails. The fixing wire may be disposed as to connect the pair of guide rails, and at least one portion of the fixing wire may be disposed in between the plurality of rails.

The plurality of rails may include a first rail movably installed and a second rail fixedly installed. The fixing wire may be provided with at least one portion thereof disposed in between the first rail and the second rail.

The pair of guide rails may each include a plurality of first brackets allowing the fixing wire to be mounted thereon.

The fixing wire may include a plurality of mounting units being mounted at the plurality of first brackets and au insertion unit provided in between the plurality of mounting units. The insertion unit may be installed such that at least one portion thereof is inserted into in between the plurality of rails.

The pair of guide rails may each include side surface units provided as to face each other, and at least one portion of the fixing wire may be mounted at the side surface units.

The pair of guide rails may each include a lower surface unit being bent from the side surface unit toward a different direction with respect to each other, and at least one portion of the fixing wire may be positioned at a lower portion of the lower surface unit.

Advantageous Effects of Invention

The left and right movements of guide rails can be stabilized by use of a fixing wire stably coupled to the guide rails.

In addition, a user can be conveniently able to clean a withdrawal unit as the guide rails and the fixing wire are coupled so as to be easily.

BRIEF DESCRIPTION OF DRAWINGS

These and/or other aspects of the disclosure will become apparent and more readily appreciated from the following description of the embodiments, taken in conjunction with the accompanying drawings of which:

FIG. 1 and FIG. 2 are drawings illustrating an oven in accordance with one embodiment of the present disclosure.

FIG. 3 and FIG. 4 are drawings illustrating a withdrawal unit of the oven in accordance with one embodiment of the present disclosure.

FIG. 5 is an exploded drawing illustrating the withdrawal unit of the oven in accordance with one embodiment of the present disclosure.

FIG. 6 and FIG. 7 are drawings illustrating a guide member of the oven in accordance with one embodiment of the present disclosure.

FIG. 8 is an enlarged drawing illustrating an 'A' portion of FIG. 6.

FIG. 9 is a drawing illustrating a cross section of the guide member of the oven in accordance with one embodiment of the present disclosure.

FIG. 10 is an exploded drawing illustrating the guide member of the oven in accordance with one embodiment of the present disclosure.

FIG. 11 is a drawing illustrating an oven in accordance with another embodiment of the present disclosure.

FIG. 12 is a drawing illustrating a withdrawal unit of the oven in accordance with another embodiment of the present disclosure.

FIG. 13 is an exploded drawing illustrating the withdrawal unit of the oven in accordance with another embodiment of the present disclosure.

MODE FOR THE INVENTION

Reference will now be made in detail to the embodiments of the present disclosure, examples of which are illustrated in the accompanying drawings, wherein like reference numerals refer to like elements throughout.

FIG. 1 and FIG. 2 are drawings illustrating an oven 1 in accordance with one embodiment of the present disclosure. FIG. 1 is a drawing illustrating the oven 1 from a front direction in a state of a door 30 thereof open, and FIG. 2 is a drawing illustrating a cross-sectional view from a side of the oven 1 in a state of the door 30 closed. A withdrawal unit 100 is schematically illustrated on FIG. 1 and FIG. 2.

The oven 1 may include a casing 10 and a cooking compartment 20 provided at an inside the casing 10. The cooking compartment 20 is provided as to have a front opening unit, and the oven 1 may include the door 30 as to open/close the front opening unit of the cooking compartment 20. The door 30 may be rotatably coupled to one side of the casing 10 as to form an exterior appearance of the casing 10.

The cooking compartment 20 is referred to as a cooking space in which food substance is cooked, and may be structured by an upper surface panel 21, a lower surface panel 22, side surface panels 23, and a rear surface panel 24. Various parts structuring the oven 1 may be disposed at a space provided in between the cooking compartment 20 and the casing 10.

A fan cover 40 may be coupled to an outer side of the rear surface panel 24. A convection fan 41 configured to circulate air through the cooking compartment 20 may be provided in between the rear surface panel 24 and the fan cover 40. At least one electrical heater 42 is installed at the convection fan 41, and a driving motor 43 connected to the convection fan 41 may be installed in between the fan cover 40 and the casing 10.

The rear surface panel 24 may include a plurality of inlet holes 25 formed such that the air at an inside the cooking compartment 20 may be moved to the convection fan 41. The plurality of inlet holes 25 may be formed at the surroundings of a central portion of the rear surface panel 24 which faces the convection fan 41. In addition, the rear surface panel 24 may include a plurality of outlet holes 26 formed such that heat may be moved to an inside the cooking compartment 20.

As to insulate the cooking compartment 20 from an outside, an insulating member 44 may be disposed at outer sides of the upper surface panel 21, the lower surface panel 22, the side surface panels 23, and the fan cover 40 forming the cooking compartment 20.

A control panel 12 configured to control the driving of the oven 1 may be installed at an upper portion of the casing 10. As for a user to open/close the cooking compartment 20, a lower portion of the door 30 may be installed while hinge-coupled to a lower end portion of the casing 10. A handle 37 may be attached to an upper portion of the door 30 such that a user may be able to grab and rotate the door 30.

The at least one withdrawal unit 100 provided such that food substance is placed may be disposed at an inside the cooking compartment 20. The withdrawal unit 100 may be installed while mounted at an inner wall of the cooking compartment 20. As for the withdrawal unit 100 to be mounted at the inner wall of the cooking compartment 100, the both side surface panels 23 may include at least one supporting member 27.

The supporting member 27 may be fixed while spaced apart with respect to each other by a predetermined distance at the each of the side surface panels 23. That is, the both side surface panels 23 are provided in the shape of plane panels, and the supporting member 27 may be able to support the withdrawal unit 100 as the supporting member 27 is fixed at the both side surface panels 23. The supporting member 27 may be provided in pairs as to restrain the withdrawal unit 100 toward vertical directions. The supporting member 27 may be provided in a plurality of pairs.

With respect to a brief description of a cooking procedure of food substance, the cooking compartment 20 is sealed by rotating the door 30 after the food substance is placed at the withdrawal unit 100 supported by the supporting member 27. Then, the electrical heater 42 is heated as the control panel 12 is manipulated, and the convection fan 41 is rotated by the driving motor 43. The air at an inside the cooking compartment 20 is inlet through the inlet holes 25, and then is heated by the electrical heater 42. The inlet air after being heated is supplied to the cooking compartment 20 through the outlet holes 26. The heated air being supplied through the outlet holes 26 may be able to cook the food substance while circulating the inside the cooking compartment 20.

FIG. 3 and FIG. 4 are drawings illustrating the withdrawal unit 100 of the oven 1 in accordance with one embodiment of the present disclosure, and FIG. 5 is an exploded drawing illustrating the withdrawal unit 100 of the oven 1 in accordance with one embodiment of the present disclosure.

The withdrawal unit 100 may include a shelf member 110, and a guide member 120 at which the shelf member 110 is mounted. In addition, the withdrawal unit 100 may include an installation member 150 mounted at an inside the cooking compartment 20.

The shelf member 110 may be disposed at an inside the cooking compartment 20 such that food substance may be mounted. The shelf member 110 may be provided in various shapes such that food substance may be mounted. As illustrated on FIG. 3 to FIG. 5, the shelf member 110 may include a bottom surface 112 provided in the shape of a plane panel such that various sizes of food substance may be mounted. The shelf member 110 may be installed such that the shelf member 110 may be moved toward a front of the cooking compartment 20 for the convenience of a user.

The installation member 150 may be detachably mounted at an inside the cooking compartment 20. The installation member 150 may be able to support the shelf member 110 and the guide member 120 while mounted at an inner wall of the cooking compartment 20. As previously described, the installation member 150 may be mounted at the side surface panels 23 by use of the supporting member 27.

The installation member 150 may include a supporting unit 152 provided as to be inserted into in between the pair of supporting members 27 that are disposed while being spaced with respect to each other. The supporting unit 152 may be provided at both sides of the installation member 150 while corresponding to the supporting members 27 provided at the both side surface panels 23. The supporting unit 152 may be provided in a protruded shape toward the both side surface panels 23 as to be disposed in between the pair of supporting members 27.

The guide member 120 may be installed such that the shelf member 110 may be withdrawn from the cooking compartment 20. The guide member 120 may include a plurality of guide rails 130, and a fixing wire 140 connecting the plurality of guide rails 130. The plurality of guide rails 130 may be installed so that the shelf member 110 may be moved. The guide rail 130 may be formed in various shapes so that the shelf member 110 may be moved.

The plurality of guide rails 130 may be provided in a pair of guide rails 130 supporting both sides of the shelf member 110. The pair of guide rails 130 supporting the shelf member 110 may be mounted at the installation member 150. That is, the pair of guide rails 130 may be disposed in between the shelf member 110 and the installation member 150.

The pair of guide rails 130 each may include a plurality of rails. The plurality of rails may include a first rail 132 at which the shelf member 110 is mounted, and a second rail 134 being mounted at the installation member 150. The first rail 132 may be installed such that the first rail 132 may be moved along with the shelf member 110. The second rail 134 may be installed such that the second rail 134 may be fixed along with the installation member 150 being mounted at an inner wall of the cooking compartment 20.

The first rail 132 may include a first bracket 131 at which the fixing wire 140 is mounted. The second rail 134 may include a second bracket 135 coupled to the installation member 150. The first bracket 131 and the second bracket 135 each may be provided in a plurality of units.

In addition, the first rail 132 may include at least one safety member 133 configured to fix the shelf member 110 toward one direction. The safety member 133 may be provided at both ends of the first rail 132 in a protruded shape toward an upper side. The shelf member 110 is mounted at an upper portion of the first rail 132, and the relative movements toward forward/backward direction with respect to the first rail 132 may be restrained by the safety member 133.

In addition, the plurality of rails may include a connecting rail 136 disposed in between the first rail 132 and the second rail 134. The connecting rail 136 is capable of supplying an extra length at which the shelf member 110 may be moved toward a front of the cooking compartment 20. A ball bearing (not shown) may be provided in between the first rail 132, and the connecting rail 136, as well as in between the connecting rail 136 and the second rail 134.

The fixing wire 140 may be positioned in between the pair of guide rails 130 as to connect the guide rails 130. The fixing wire 140 may be provided as to connect the first rails 132 each disposed at the each of the pair of guide rails 130.

The fixing wire 140 may include a handle unit 148 provided such that a user may be able to grip. As for a user to grip, the handle unit 148 may be provided toward a front of the cooking compartment 20. A user may be able to withdraw the withdrawal unit 100 disposed as illustrated on FIG. 3 toward a front while applying an outside force by gripping the handle unit 148. According to the above, the shelf member 110 is moved toward a front as illustrated on FIG. 4, and a user may be able to withdraw/deposit food substance from/to the shelf member 110.

FIG. 6 and FIG. 7 are drawings illustrating the guide member 120 of the oven 1 in accordance with one embodiment of the present disclosure, and FIG. 8 is an enlarged drawing illustrating an 'A' portion of FIG. 6. FIG. 7 is a drawing illustrating an upper surface of the guide member 120, and for the purpose of descriptions, one side of FIG. 8 is cut out and illustrated.

In addition, FIG. 9 is a drawing illustrating a cross section of the guide member 120 of the oven 1 in accordance with one embodiment of the present disclosure, and FIG. 10 is an exploded drawing illustrating the guide member 120 of the oven 1 in accordance with one embodiment of the present disclosure.

As previously described, the guide member 120 includes the guide rail 130 and the fixing wire 140, and the guide rail 130 and the fixing wire 140 may be detachably coupled to each other. As for the pair of guide rails 130, which is disposed while spaced apart from each other, may be moved while interlocked with respect to each other, the fixing wire 140 may be installed as to connect the guide rails 130.

As illustrated on FIG. 10, the fixing wire 140 may be provided in the shape of a closed loop as to connect the pair of guide rails 130. The fixing wire 140 may be provided in the shape of a rectangular frame that is formed by bending.

The fixing wire 140 may include a plurality of contact units 142 each making contact with the each of the plurality of guide rails 130. The contact unit 142 may be provided at both sides by corresponding to the pair of guide rails 130. As one surface of the fixing wire 140 provided in the shape of a rectangular frame is entirely making contact with the guide tail 130, the contact unit 142 may be referred to as one surface of the fixing wire 140.

The each contact unit 142 may be formed while provided with a step. The each contact unit 142 may include a plurality of mounting units 146 mounted at the first bracket 131, and an insertion unit 144 provided in between the plurality of mounting units 146. At this time, the plurality of mounting units 146 and the insertion unit 144 may be formed while provided with a step.

As illustrated on FIG. 6 to FIG. 8, the insertion unit 144 may be provided such that the insertion unit 144 is further protruded then the mounting unit 146 with respect to the guide rail 130. Thus, the insertion unit 144 may be installed such that at least one portion thereof may be inserted into in between the guide rail 130. That is, the fixing wire 140 may be provided with at least one portion thereof disposed in between the first rail 132 and the second rail 134.

The first bracket 131 may be disposed at one side surface of the guide rail 130. The mounting unit 146 may be mounted at the first bracket from an upper portion to a lower portion. As illustrated on FIG. 8, one side of the first bracket 131 is fixed to one side surface of the first rail 132, and the other side of the first bracket 131 may be extended as to accommodate the mounting unit 146. The first bracket 131 and the mounting unit 146 correspondingly provided with respect to the first bracket 131 may be provided in a plurality of units at the pair of guide rails 130.

As illustrated on FIG. 8 and FIG. 9, the first rail 132 may be formed in a bent manner as to be provided with an accommodating space at an inside thereof. The connecting rail 136, etc. may be disposed at the accommodating space, and the first rail 132 may be provided while wrapping around at least one portion of the connecting rail 136, etc.

At this time, a surface provided at an upper portion of the first rail 132 such that the shelf member 110 may be mounted is referred to as an upper surface unit 137. In addition, a surface at which the first bracket 131 is positioned at the first rail 132 is referred to as a side surface unit 138. The side surface unit 138 is provided with one side thereof connected to the upper surface unit 137, and the other side of the side surface unit 138 may be connected to a lower surface unit 139. The lower surface unit 139 may be provided in a bent mariner toward the accommodating space from the side surface unit 138.

That is, the mounting unit 146 is restrained toward a lower direction by the first bracket 131, and the insertion unit 144 may be restrained toward an upper direction by the side surface unit 138 and the lower surface unit 139. Thus, the contact unit 142 may be coupled to the guide rail 130 while restrained toward vertical directions, and the fixing wire 140 may be able to firmly connect the pair of guide rails 130.

As illustrated on FIG. 9, the second rail 134 as well may be provided while provided. with an identical cross-sectional surface with respect to the first rail 132. At this time, the insertion unit 144 may be provided with at least one portion thereof disposed in between the first rail 132 and the second rail 134. The insertion unit 144 may be disposed while making contact with the first rail 132 so that the insertion unit 144 may be able to be moved along with the first rail 132. As to prevent an occurrence of a friction with respect to the second rail 134 while the fixing wire 140 and the first rail 133 are moved, the insertion unit 144 may be disposed not to make contact with the second rail 134.

FIG. 11 is a drawing illustrating an oven 1*a* in accordance with another embodiment of the present disclosure. Hereinafter, other than the details that are to be described, the descriptions with respect to FIG. 1 and FIG. 2 that are previously described will be cited.

The oven 1*a* may include a casing 10*a*, a cooking compartment 20*a* provided at an inside the casing 10*a*, and a door 30*a* provided as to open/close the cooking compartment 20*a*. A handle 37*a* may be attached to the door 30*a*.

In addition, the cooking compartment 20*a* may be structured by an upper surface panel :21*a*, a lower surface panel 22*a*, side surface panels 23*a*, and a rear surface panel 24*a*. The rear surface panel 24*a* may include a plurality of inlet holes 25*a* and a plurality of outlet holes 26*a*. In addition, a control panel 12*a* may be installed at the casing 10*a*.

At least one withdrawal unit 100*a* is disposed at an inside the cooking compartment 20*a*, and the withdrawal unit 100*a* may be installed while mounted at an inner surface of the cooking compartment 20*a*. As the withdrawal unit 100*a* to be mounted at the inner wall of the cooking compartment 20*a*, the both side surface panels 23*a* may include a concavo-convex structure.

The concavo-convex structure may include a plurality of concave surfaces 28 each spaced apart by a predetermined distance at the side surface panels 23*a*. That is, the side surface panels 23*a* are not provided in a plane manner, and the side surface panels 23*a* may be directly able to support the withdrawal unit 100*a*. In addition, the convex surfaces 28 each may be disposed at a predetermined position so that the withdrawal unit 100*a* may be installed at a height that is needed for a user.

FIG. 12 is a drawing illustrating the withdrawal unit 100*a* of the oven 1*a* in accordance with another embodiment of the present disclosure, and FIG. 13 is an exploded drawing illustrating the withdrawal unit 100*a* of the oven 1*a* in accordance with another embodiment of the present disclosure. Hereinafter, other than the details that are to be described, the descriptions with respect to FIG. 3 to FIG. 10 that are previously described will be cited.

The withdrawal unit 100*a* may include a shelf member 110*a*, a guide member 120*a*, and an installation member 150*a*. As illustrated on FIG. 12, the shelf member 110*a* may include a bottom surface 112*a* provided by use of wires arranged toward one direction.

The installation member 150*a* may be mounted at the concave surface 28 provided at the side surface panel 23*a*. The installation member 150*a* may include a supporting unit 152*a* provided as to be inserted into the concave surface 28. The supporting units 152*a* may be provided at the both sides of the installation member 150*a* while corresponding to the concave surfaces 28 that are provided at the both side surface panels 23*a*. The supporting units 152*a* may be provided in a protruded shape toward the both side surface panels 23*a* as to be mounted at the concave surfaces 28.

The guide member 120*a* may include a pair of guide rails 130*a* and a fixing wire 140*a*. The pair of guide rails 130*a* each may include a plurality of rails. The plurality of rails may include a first rail 132*a* at which the shelf member 110*a* is mounted, and a second rail 134*a* being mounted at the installation member 150*a*. A ball bearing (not shown) may be provided in between the first rail 132*a* and the second rail 134*a*. The first rail 132*a* includes a first bracket 131*a* and a safety member 133*a*, and the second rail 134*a* may include a second bracket 135*a*.

The fixing wire 140*a* may include a plurality of contact units 142*a* and a handle unit 148*a*. The each contact unit 142*a* may include a plurality of mounting units 146*a*, and an insertion unit 144*a* provided in between the plurality of mounting units 146*a*. At this time, the plurality of mounting units 146*a* and the insertion unit 144*a* may be formed while provided with a step.

Although a few embodiments of the present disclosure have been shown and described, it would be appreciated by those skilled in the art that changes may be made to the embodiments without departing from the principles and spirit of the invention, the scope of which is defined in the claims and their equivalents.

The invention claimed is:

1. An oven, comprising:

a cooking compartment comprising side surface panels;

a shelf member disposed at an inside of the cooking compartment to allow food to be mounted thereon;

a plurality of guide rails configured to support both sides of the shelf member to guide a withdrawal of the shelf member from the cooking compartment, each of the plurality of guide rails including a first rail and a second rail; and a fixing wire detachably coupled to the first rail of each of the plurality of guide rails to couple the plurality of guide rails to each other, the fixing wire having a plurality of contact units configured to contact the plurality of guide rails, respectively, wherein at least one contact unit of the plurality of contact units includes a plurality of mounting units and an insertion unit provided between the plurality of mounting units, wherein the insertion unit is further protruded toward the side surface panels than the plurality of mounting units so that at least one portion of the insertion unit is inserted between the first and the second rail.

2. The oven of claim 1, wherein:

each of the guide rails comprises a plurality of first brackets at which the fixing wire is mounted.

3. The oven of claim 2, wherein:

the plurality of mounting units are mounted at the plurality of first brackets and the insertion unit is provided between the plurality of mounting units, and the plurality of mounting units and the insertion unit together form a step shape.

4. The oven of claim 3, wherein:

the plurality of mounting units each is mounted at each of the plurality of first brackets in a downward direction with respect to the cooking compartment, and the insertion unit is disposed such that at least one portion of each of the guide rails is positioned at an upper portion of the insertion unit.

5. The oven of claim 2, wherein:

the plurality of first brackets each is disposed at one side surface of each of the guide rails.

6. The oven of claim 1, wherein:

the fixing wire is provided in a shape of a closed loop as to couple the plurality of guide rails to each other.

7. The oven of claim 1, wherein:

the fixing wire couples the plurality of guide rails by being positioned between the pair of guide rails.

8. The oven of claim 1, wherein:

the fixing wire comprises a handle unit provided as to be grabbed.

9. The oven of claim 1, further comprising:

an installation member at which the plurality of guide rails are mounted.

10. The oven of claim 9, wherein:

the first rail includes a first pair of rails coupled to the fixing wire, and the second rail includes a second pair of rails mounted at the installation member.

11. The oven of claim 10, wherein:

the first rail of the first pair of rails comprises a first bracket at which the fixing wire is mounted, and the second rail of the second pair of rails comprises a second bracket coupled to the installation member.

12. The oven of claim 10, wherein:

the first rail of the first pair of rails comprises at least one safety member configured to fix the shelf member to one direction.

13. The oven of claim 9, wherein:

the installation member is mounted at an inner side wall of the cooking compartment, as to support the shelf member and the guide rails.

14. The oven of claim 9, wherein:

the cooking compartment comprises at least one supporting member being installed at an inner side wall of the cooking compartment, such that the installation member is mounted at the inner side wall of the cooking compartment.

15. The oven of claim 9, wherein:

an inner side wall of the cooking compartment comprises at least one concave surface such that the installation member is mounted at the inner side wall of the cooking compartment.

* * * * *